United States Patent [19]

Yuasa

[11] 4,280,697

[45] Jul. 28, 1981

[54] TENNIS TRAINING DEVICE

[76] Inventor: Sueto Yuasa, 5-9-10, Seta, Setagaya-ku, Tokyo, Japan

[21] Appl. No.: 97,783

[22] Filed: Nov. 27, 1979

[30] Foreign Application Priority Data

Nov. 30, 1978 [JP] Japan ..... 53-165190[U]

[51] Int. Cl.[3] ..... A63B 69/00

[52] U.S. Cl. ..... 273/29 A; 124/78; 124/51 A; 124/50

[58] Field of Search ..... 273/26 R, 26 D, 29 A, 273/29 R; 124/1, 51 A, 51 R, 78, 6, 81

[56] References Cited

U.S. PATENT DOCUMENTS

| | | | |
|---|---|---|---|
| 2,646,785 | 7/1953 | Goldman | 124/51 R |
| 3,203,696 | 8/1965 | Sawyer | 273/29 R |
| 3,538,900 | 11/1970 | Samuels | 124/51 A |
| 3,766,901 | 10/1973 | Cleary et al. | 273/29 A |
| 3,777,732 | 12/1973 | Holloway et al. | 124/51 R |
| 3,785,358 | 1/1974 | D'Angelo | 124/78 |
| 3,855,988 | 12/1974 | Sweeton | 124/51 R |
| 3,989,246 | 11/1976 | Brown et al. | 124/51 A |
| 4,077,386 | 3/1978 | Berliner | 124/51 A |
| 4,094,294 | 6/1978 | Speer | 124/51 R |
| 4,108,432 | 8/1978 | Clark et al. | 124/51 A |

*Primary Examiner*—Richard C. Pinkham
*Assistant Examiner*—T. Brown
*Attorney, Agent, or Firm*—Thomas R. Morrison

[57] ABSTRACT

A tennis training device having a ball emitter including a ball emitting cylinder is disclosed. In this case, a device is provided for controlling horizontally and vertically inclined angles of the ball emitting cylinder. This controlling device is composed of a supporting member for the ball emitting cylinder, two low speed motors each rotatable in forward and reverse directions, links for connecting the supporting member to the two motors, respectively. An electric power supply source is connected to the two motors for supplying input current to the two motors, and a remote control panel is connected through the electric supply source to the two motors, includes change-over switches for changing over the input to the two motors and rotates the ball emitting cylinder in horizontal and vertical directions so as to control horizontally and vertically inclined angles of the ball emitting cylinder.

6 Claims, 7 Drawing Figures

TENNIS TRAINING DEVICE

BACKGROUND OF THE INVENTION

1. Field of the Invention

This invention relates to a tennis training device comprising a ball emitter including a ball emitting cylinder for emitting a ball to a player's side.

2. Description of the Prior Art

In such a kind of tennis training device adapted to emit a ball from a ball emitter to a player's side, many attempts have been made to finely control horizontally and vertically inclined angles of a ball emitting cylinder, but none has led to a fully satisfactory result.

SUMMARY OF THE INVENTION

An object of the present invention, therefore, is to provide a tennis training device comprising a ball emitter including a ball emitting cylinder, which can finely and freely control horizontally and vertically inclined angles of the ball emitting cylinder.

A feature of the invention is the provision in a tennis training device comprising a ball emitter including a ball emitting cylinder, of the improvement comprising means for controlling horizontally and vertically inclined angles of said ball emitting cylinder and composed of a supporting member for said ball emitting cylinder, two low speed motors each rotatable in forward and reverse directions, links for connecting said supporting member to said two motors, respectively, an electric supply source connected to said two motors and for supplying input current to said two motors, and a remote control panel connected through said electric supply source to said two motors and including change-over switches for changing over the input to said two motors and rotating said ball emitting cylinder in horizontal and vertical directions so as to control horizontally and vertically inclined angles of said ball emitting cylinder.

Further objects, features, and advantages of the invention will be fully understood from the following detailed description with reference to the accompanying drawings.

DETAILED DESCRIPTION OF THE PREFERRED EMBODIMENTS

Figure 1:
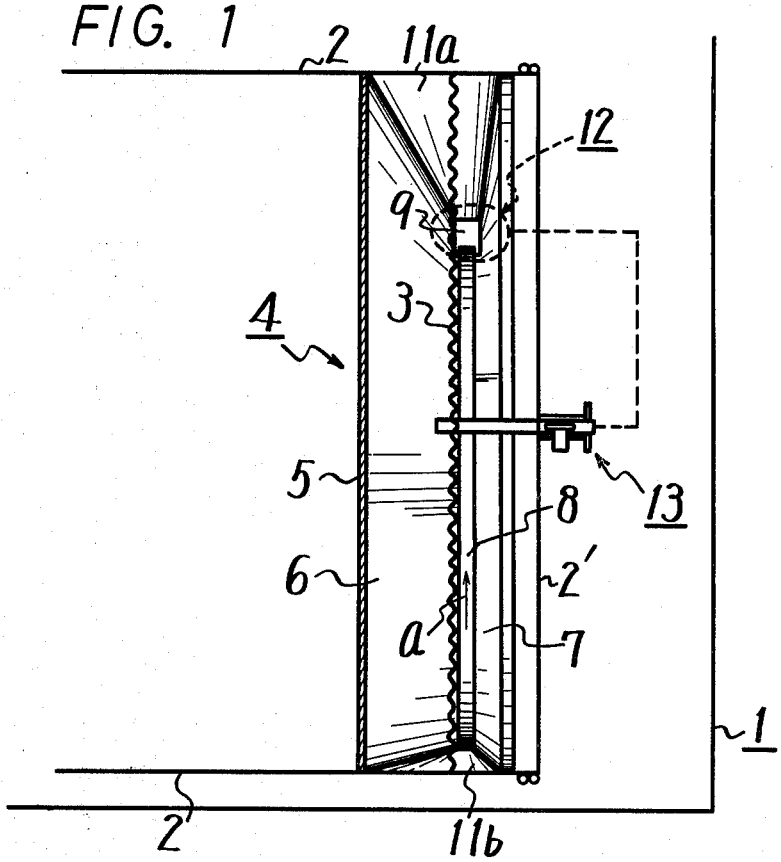
FIG. 1 is a diagrammatic plan view of essential parts of one embodiment of a tennis training device according to the invention.
Figure 2:
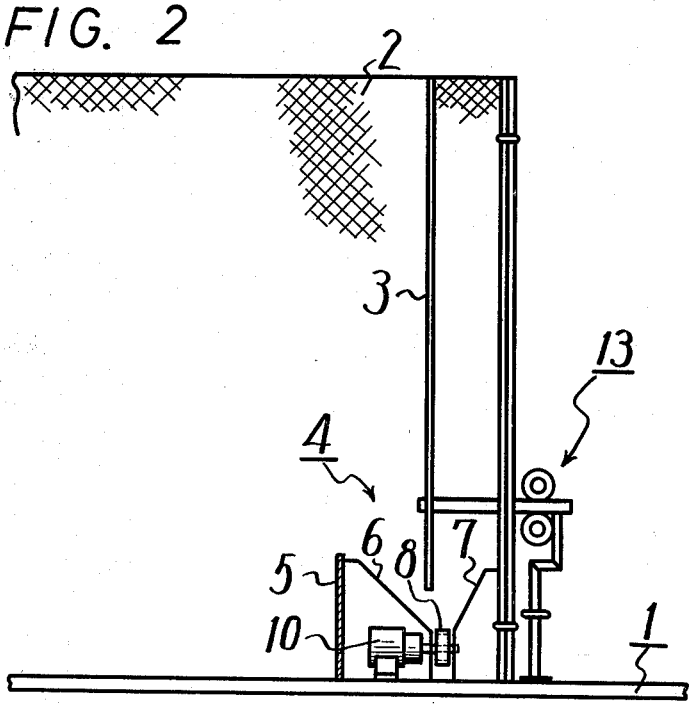
FIG. 2 is its partial longitudinal sectional view.

FIG. 1 is a diagrammatic plan view of essential parts of one embodiment of a tennis training device according to the invention and FIG. 2 is its longitudinal sectional view. Referring to FIGS. 1 and 2, reference numeral 1 designates a ground surface such as a concrete floor, tennis court per se or the like substrates in general and 2 a surrounding net installed around the ground surface

1. Players stand at the left and in front of the surrounding net 2 and train for various kinds of balls. A player's hit ball is transferred through a ball collector and ball distributor to a ball emitter, all of these means being arranged in the rear of the surrounding net 2 and described hereinafter. The ball emitter functions to cyclically emit the ball toward the player's side. Various kinds of such tennis training device have heretofore been well known in the art.

In the present embodiment, provision is made of an undulated curtain 3 formed of a strong fiber sheet. The curtain 3 is distant apart from a back net 2' of the surrounding net 2 and suspended from the top of the net 2. The curtain 3 functions to receive the ball hit by the player and absorb the ball's energy, thereby dropping the ball along the front surface of the curtain 3.

Below the curtain 3 is arranged a ball collector 4 provided at its front with a target net 5. The ball collector 4 functions to transfer the dropped ball toward the left, for example, viewed from the front surface side.

The ball collector 4 is composed of a main inclined plate 6 extending downwardly from the upper edge of the target net 5 toward the rear surface side, an inclined plate 7 opposed to the main inclined plate 6 so as to define a substantially V-shaped transfer path, and a belt conveyor 8 arranged at the base of the substantially V-shaped transfer path. The main inclined plate 6 serves to guide the ball dropped thereon along the curtain 3 onto the belt conveyor 8 and then to a ball collecting hole 9 arranged at the end of the belt conveyor 8. In the present embodiment, the belt conveyor 8 is arranged in parallel to the ground surface 1. Since the ball is forcedly transferred in a direction shown by an arrow a in FIG. 1 by means of the belt conveyor 8, the ball is transferred in a smooth manner.

In FIG. 2, reference numeral 10 designates a motor with a speed reduction gear for driving a main pulley of the belt conveyor 8. In FIG. 1, reference numerals 11*a* and 11*b* represent inclined plates adapted to close the left and right end portions of the ball transfer path, respectively.

Figure 3:
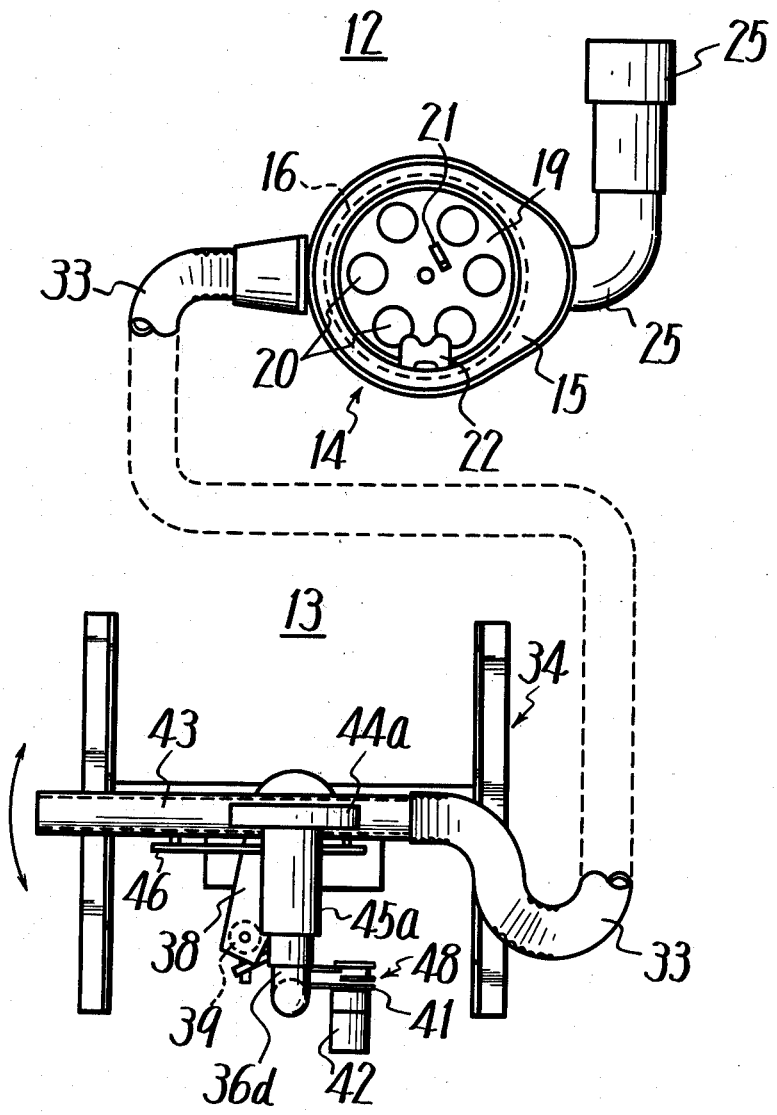
FIG. 3 is a plan view of a ball distributor and a ball emitter for a tennis training device according to the invention.

With the ball collector 4 are associated the ball distributor and ball emitter. In FIGS. 1 and 3, reference numeral 12 shows a ball distributor arranged below the ball collecting hole 9 and 13 a ball emitter extending through the center part of the back net 2' and the curtain 3. The ball distributor 12 and ball emitter 13 will now be described.

Figure 4:
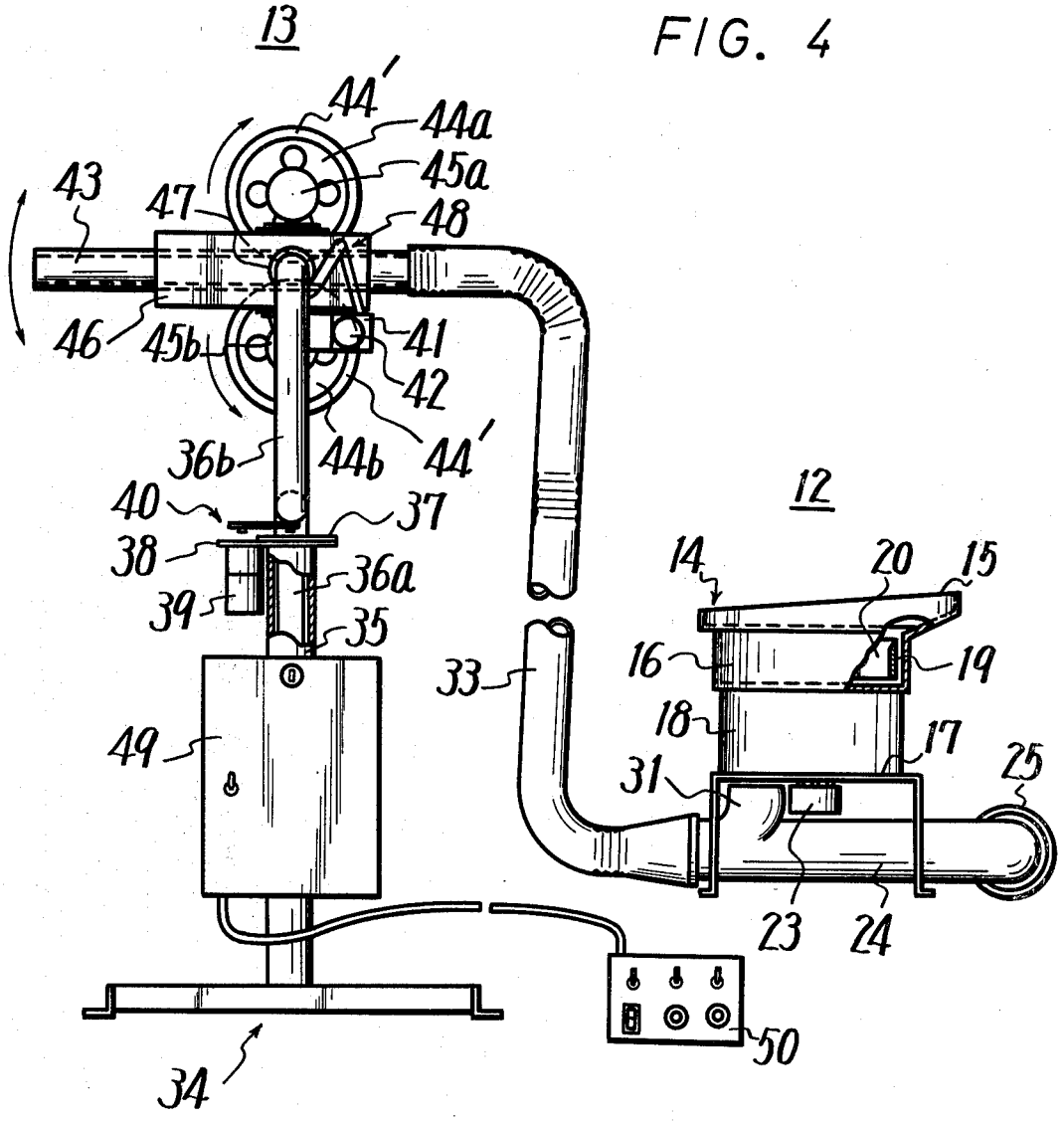
FIG. 4 is its side elevational view.

FIG. 3 is a plan view of the ball distributor 12 and ball emitter 13 and FIG. 4 is its side elevational view. In FIGS. 3 and 4, reference numeral 12 designates a ball distributor as a whole, 14 an upper body of the ball distributor 12 composed of a ball receiving hopper 15 and a circular ball receiving dish 16, 17 a supporting base, 18 a cylindrical frame for firmly securing the upper body 14 to the supporting base 17 and 19 a drum adapted to rotate in the receiving dish 16 at a low speed. The drum 19 is provided at its coaxial circle with even number, for example, six punched bores 20 equidistantly separated from each other and extending through the drum 19.

Each punched bore 20 is adapted to permit the ball dropped from the above mentioned ball collecting hole 9 to enter thereinto one by one. The drum 19 is provided at its upper surface with a projection 21 formed, for example, of a triangular piece and is located at an eccentric position arranged inside the punched bores 20.

The projection 21 is secured to the drum 19 and functions to agitate the dropped balls so as to separate them one from the other.

In FIG. 3, reference numeral 22 designates a ball control piece formed of a thin resilient plate and secured to the upper inner periphery of the ball receiving dish 16. The ball control piece 22 functions to permit the ball to enter into a ball retaining cylinder to be described later one by one.

In FIG. 4, reference numeral 23 designates a motor for driving the drum 19 and a rotary disc to be described later at a low speed, 24 a ball transfer joint pipe, and 25 a blower connected to the end of the ball transfer joint pipe 24.

Figure 5:
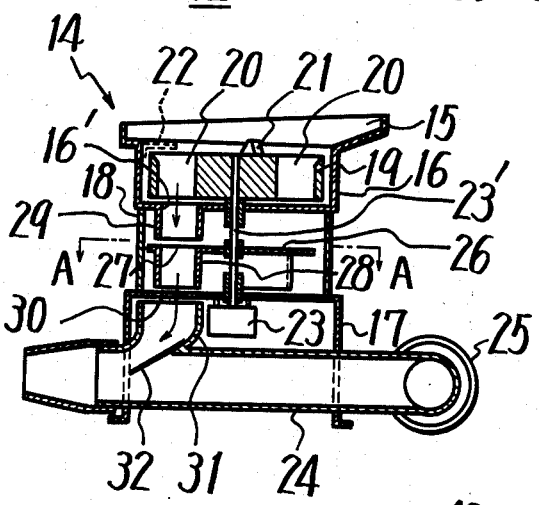
FIG. 5 is a longitudinal view of essential parts of the ball distributor shown in FIGS. 3 and 4.
Figure 6:
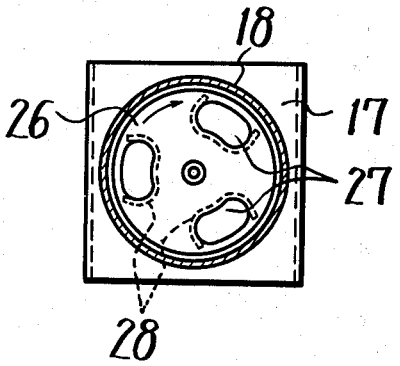
FIG. 6 is a section on line A—A of FIG. 5.

FIG. 5 is a longitudinal sectional view of the ball distributor 12 showing the internal construction of essential parts thereof and FIG. 6 is a section on the line A—A of FIG. 5. In FIGS. 5 and 6, parts corresponding to those shown in FIGS. 3 and 4 are designated by the same reference numerals. In FIGS. 5 and 6, reference numeral 26 designates a rotary disc arranged in the cylindrical frame 18 and operative to move the ball. The rotary disc 26 and drum 19 are secured to a rotary driving shaft 23' of the motor 23 and driven in synchronism with each other. The rotary disc 26 is provided at its inner periphery with deformed elliptical bores 27 arranged along the same circle as that along which are arranged the punched bores 20. These bores 27 are ½ times smaller in number than the punched bores 20, in the present embodiment, 3 in number and equidistantly spaced apart from each other. Substantially one half periphery of each of the elliptical bores 27 is surrounded by a thin peripheral wall 28. The thin peripheral wall 28 is secured to that part of the lower surface of the rotary disc 26 which is faced toward the center thereof and adapted to supply the ball into each of the elliptical bores 27 one by one.

The receiving dish 16 is provided at its base plate with a ball retaining cylinder 29 around a bore 16'. The ball retaining cylinder 29 is arranged at a position aligned with the elliptical bore 27 of the rotary disc 26 and corresponding to the ball control piece 22 and slightly spaced apart from the upper surface of the rotary disc 26. The supporting base 17 is provided at its upper plate with one opening 30 above which is passed the elliptical bore 27. To the opening 30 is opposed a communication cylinder 31 forming a part of the joint pipe 24. The communication cylinder 31 is provided at its base portion with a valve 32 formed of a thin rubber plate and secured to the communication cylinder 31 as shown in FIG. 5.

In the ball distributor 12 constructed as above described, the ball received by the punched bore 20 of the drum 19 is entered into the retaining cylinder 29 when the punched bore 20 is brought into engagement with the retaining cylinder 29 one by one. Subsequently, when the elliptical bore 27 of the rotary disc 26 is brought into engagement with the retaining cylinder 29, the ball is positioned at the inner peripheral wall 28 and transferred along the upper plate surface of the supporting base 17. When the ball arrives at the opening 30, the ball is dropped into the communication cylinder 31. The dropping energy of the ball causes the valve 32 to move downwardly into the joint pipe 24 at every constant time without any interruption. Even if the ball fails to enter into any of the punched bores 20, the above mentioned arrangement of the drum 19, ball retaining cylinder 29, rotary disc 26 and opening 30 makes it possible to enter the ball into the punched bore 20 again and finally into the joint pipe 24.

As shown in FIGS. 3 and 4, the joint pipe 24 of the ball distributor 12 is connected through, for example, a flexible hose 33 to a ball emitter 13, more particularly a ball emitting cylinder to be described later. The ball dropped into the joint pipe 24 is transferred under wind pressure one by one by means of the blower 25.

Figure 7:
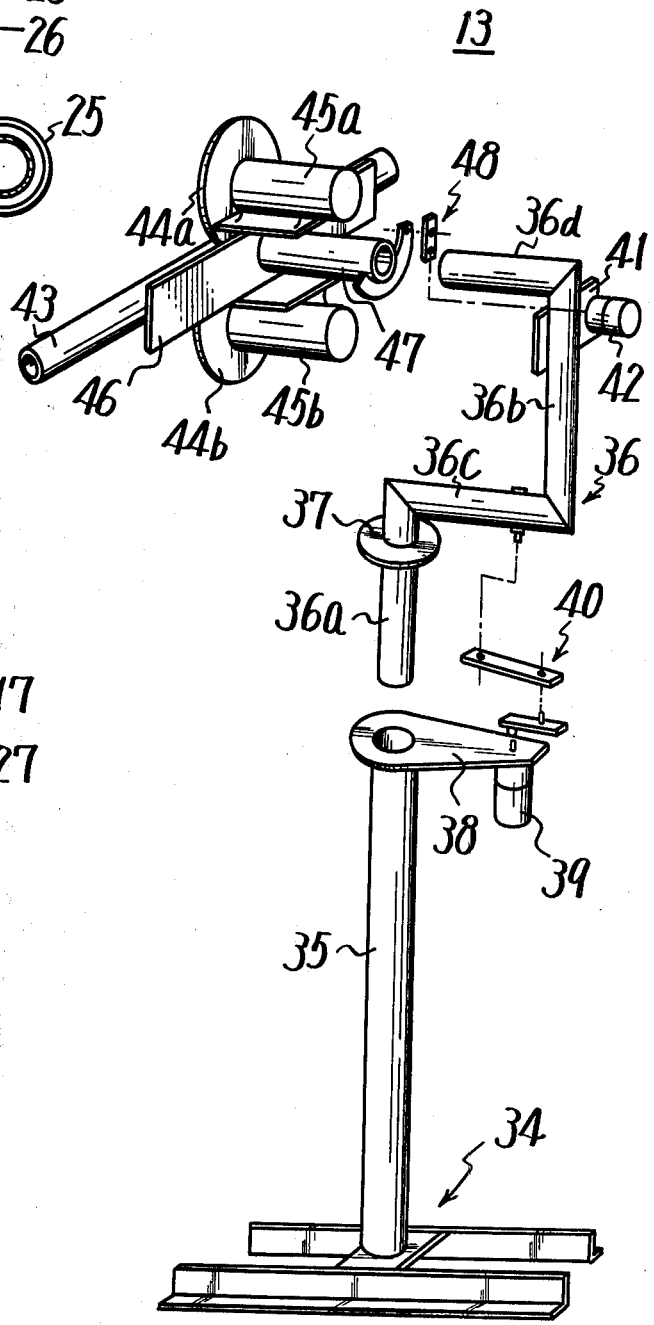
FIG. 7 is a fragmentary perspective view of the ball emitter shown in FIGS. 3 and 4.

FIG. 7 is a fragmentary perspective view of essential parts of the ball emitter. In FIGS. 3, 4 and 7, reference numeral 13 designates the ball emitter as a whole whose construction will be described mainly with reference to FIG. 7. In FIG. 7, reference numeral 34 designates a supporting base formed of a channel steel, 35 a cylindrical column extending in a direction perpendicular to the supporting base 34, and 36 a crank member. The crank member 36 is composed of vertical portions **36*a*, 36*b* and horizontal portions 36*c*, 36*d*. The vertical portion 36*a* is rotatably journalled in the upper end of the cylindrical column 35 and provided with a flange 37 which functions as a stopper to limit the engaged position of the vertical portion 36*a*. Reference numeral 38 designates a fixture plate secured to the upper end of the cylindrical column 35 and supporting a first motor 39. The first motor 39 is secured to the lower surface of the free end of the fixture plate 38 and adapted to rotate the ball emitting cylinder in a horizontal direction. 40 shows a plurality of links adapted to rotate the crank member 36 in a horizontal direction by means of the first motor 39, and 41 a fixture plate secured to the vertical portion 36*b* of the crank member 36 and supporting a second motor 42**.

The second motor 42 is secured to the right side surface of the fixture plate 41 and adapted to rotate the ball emitting cylinder to be described later in a vertical direction. The first motor 39 and the second motor 42 are of low speed ones and rotatable in forward and reverse directions by changing over the inputs to these motors.

That is, the first motor 39 and the second motor 42 function to minutely control horizontally inclined angle and vertically inclined angle of the ball emitting cylinder to be described later, respectively. If the input to these motors is changed over, it is possible to reverse the rotation of these motors and hence to correct the inclined angle of the ball emitting cylinder in the opposite direction.

In FIGS. 3, 4 and 7, reference numeral 43 designates a ball emitting cylinder, **44*a* and 44*b* upper and lower ball emitting pulleys located at up and down sides of the cylinder 43 and each having a peripheral portion extended through a slit formed in the upper and lower peripheral surface of the ball emitting cylinder 43 thereinto, 45*a* and 45*b* upper and lower pulley driving motors, 46 a fixture base plate for supporting the ball emitting cylinder 43 and driving motors 45*a*, 45*b*, and 47 a cylinder secured to the center part, for example, of the fixture base plate 46. The cylinder 47 engages with or is connected the horizontal cylindrical portion 36*d* of the crank member 36 and is connected through a plurality of links 48, which are substantially similar to the horizontally rotating links 40, to the vertically rotating motor 42, thereby providing the ball emitter 13** as a whole.

The respective members of the ball emitter 13 shown in FIGS. 3 and 4 are designated by like reference numerals showing the corresponding members of the ball emitter 13 shown in FIG. 7. The ball emitting ability and methods of adjusting the inclined angle in the horizontal and vertical directions of the ball emitting cylinder 43 or the like can be understood if referred to the above description. Each of the upper and lower ball emitting pulleys 44*a* and 44*b* is provided around its outer periphery with a rubber tire 44' engaged therewith. Since the peripheral speed of each pulley can be changed by controlling the input voltage applied to the driving motors 45*a* and 45*b*, the ball may be rotated and hence applied with a drive.

In FIG. 4, reference numeral 49 designates an electric supply source box secured to the cylindrical column 35 of the supporting base 34 of the ball emitter 13, and 50 a remote control panel including change-over switches or the like and for effecting the above mentioned various controls.

As stated hereinbefore, the tennis training device according to the invention is capable of controlling inclined angles of a ball emitting cylinder in any of horizontal and vertical directions and of remotely controlling the ball emitting cylinder in an easy and precise manner.

It will be apparent that many modifications and variations could be effected by one skilled in the art without departing from the spirits or scope of the novel concepts of the present invention so that the spirits or scope of the invention should be determined by the appended claims only.

I claim as my invention:

1. A tennis training device, comprising:

(a) ball emitting means including ball emitting cylinder and ball rotating means for cyclically emitting tennis balls to a player's side through said ball emitting cylinder;

(b) ball collecting means for collecting tennis balls hit by the player;

(c) ball transferring means for transferring said tennis balls collected by said ball collecting means to said ball emitting means one by one;

(d) control means for controlling horizontal and vertical angles of said ball emitting cylinder;

(e) a supporting base;

(f) a post vertically secured at its lower end to said supporting base and having a fixture plate at its top end;

(g) a crank member one end of which is rotatably received in the top end portion of said post and which is coupled to said fixture plate through a link; and (h) a base plate to which said ball emitting means is secured and which is coupled to said crank member through a link.

2. A tennis training device as claimed in claim 1, in which said control means includes first and second motors, each of which can be driven at a low speed in forward and backward directions in response to currents applied thereto from a power source so as to vary the horizontal and vertical inclined angles of said ball emitting cylinder.

3. A tennis training device as claimed in claim 1, in which said ball rotating means of said ball emitting means includes third and fourth motors which are rotated in opposite directions so as to rotate a tennis ball transferred from said ball collecting means to said ball emitting cylinder.

4. A tennis training device as claimed in claim 3, in which said third and fourth motors have pulleys fixed to their rotating shafts, respectively, parts of said pulleys protruding through said ball emitting cylinder thereinto to rotate the tennis ball brought into said ball emitting cylinder to thereby emit said tennis ball to the player's side.

5. A tennis training device as claimed in claim 4, in which each of said pulleys has a rubber tire on its outer periphery.

6. A tennis training device as claimed in claim 1, in which said ball rotating means is supported by said base plate and said control means is supported by said fixture plate and said crank member.

* * * * *